US012130071B2

(12) United States Patent
Fei et al.

(10) Patent No.: US 12,130,071 B2
(45) Date of Patent: Oct. 29, 2024

(54) VACUUM ADIABATIC BODY AND REFRIGERATOR

(71) Applicants: QINGDAO HAIER REFRIGERATOR CO., LTD., Shandong (CN); HAIER SMART HOME CO., LTD., Shandong (CN)

(72) Inventors: Bin Fei, Qingdao (CN); Xiaobing Zhu, Qingdao (CN); Zhanzhan Liu, Qingdao (CN); Peng Li, Qingdao (CN); Peng Zhang, Qingdao (CN)

(73) Assignees: Qingdao Haier Refrigerator Co., Ltd., Qingdao (CN); Haier Smart Home Co., Ltd., Qingdao (CN)

( * ) Notice: Subject to any disclaimer, the term of this patent is extended or adjusted under 35 U.S.C. 154(b) by 214 days.

(21) Appl. No.: 17/789,758

(22) PCT Filed: Sep. 29, 2020

(86) PCT No.: PCT/CN2020/118856

§ 371 (c)(1),
(2) Date: Jun. 28, 2022

(87) PCT Pub. No.: WO2021/139267

PCT Pub. Date: Jul. 15, 2021

(65) Prior Publication Data

US 2023/0038053 A1 Feb. 9, 2023

(30) Foreign Application Priority Data

Jan. 6, 2020 (CN) ..... 202010011081.0

(51) Int. Cl.
*F25D 23/02* (2006.01)
*F25D 23/06* (2006.01)

(52) U.S. Cl.
CPC ..... *F25D 23/02* (2013.01); *F25D 23/062* (2013.01); *F25D 2201/14* (2013.01)

(58) Field of Classification Search
CPC ..... F25D 23/02; F25D 2201/14
See application file for complete search history.

(56) References Cited

U.S. PATENT DOCUMENTS 4,745,015 A * 5/1988 Cheng ..... E04B 1/803 428/920
6,038,830 A * 3/2000 Hirath ..... F16L 59/065 428/69

(Continued)

FOREIGN PATENT DOCUMENTS

CN 103189696 A * 7/2013 ..... C03C 27/06
CN 103936293 A 7/2014

(Continued)

OTHER PUBLICATIONS

International Search Report and Written Opinion for PCT/CN2020/118856 (ISA/CN) mailed Dec. 7, 2020 (11 pages).

(Continued)

*Primary Examiner* — Andrew Roersma
(74) *Attorney, Agent, or Firm* — Alston & Bird LLP

(57) ABSTRACT

A vacuum adiabatic body and a refrigerator having the vacuum adiabatic body. The vacuum adiabatic body comprises: a first plate, the first plate having a first thickness; a second plate spaced apart from the first plate in an opposite manner, the second plate having a second thickness, and the first thickness being greater than the second thickness; and sealing members arranged between the first plate and the second plate and configured to seal and fix the first plate and the second plate, a vacuum cavity being defined among the first plate, the second plate, and the sealing members. According to the vacuum adiabatic body, convection heat transfer can be reduced by vacuumizing between two plates (Continued)

which are sealingly connected; and the whole vacuum insulation body is stable in structure and not too heavy.

9 Claims, 10 Drawing Sheets

(56) References Cited

U.S. PATENT DOCUMENTS

| | | | | |
|---|---|---|---|---|
| 6,217,140 | B1 * | 4/2001 | Hirath | F25D 23/062 52/788.1 |
| 6,717,052 | B2 | 4/2004 | Wang et al. | |
| 10,024,098 | B2 | 7/2018 | Abe et al. | |
| 10,337,787 | B2 | 7/2019 | Kal et al. | |
| 10,378,272 | B2 | 8/2019 | Abe et al. | |
| 10,539,265 | B2 * | 1/2020 | Kitano | F16L 59/065 |
| 10,619,403 | B2 | 4/2020 | Abe et al. | |
| 10,928,119 | B2 * | 2/2021 | Jung | F16L 59/065 |
| 2002/0183557 | A1 | 12/2002 | Takagi et al. | |
| 2009/0031659 | A1 * | 2/2009 | Kalfon | H05K 5/0209 137/511 |
| 2013/0236662 | A1 | 9/2013 | Dua et al. | |
| 2015/0125634 | A1 | 5/2015 | Jefferson | |
| 2017/0096284 | A1 * | 4/2017 | Hirano | F25D 23/065 |
| 2018/0017314 | A1 * | 1/2018 | Jeong | F25D 23/061 |
| 2018/0224196 | A1 | 8/2018 | Jung et al. | |
| 2019/0177219 | A1 | 6/2019 | Karam et al. | |

FOREIGN PATENT DOCUMENTS

| | | | | | |
|---|---|---|---|---|---|
| CN | 104302593 | A | | 1/2015 | |
| CN | 104350014 | A | | 2/2015 | |
| CN | 104773963 | A | | 7/2015 | |
| CN | 106795046 | A | | 5/2017 | |
| CN | 107923700 | A | | 4/2018 | |
| CN | 207741420 | U | | 8/2018 | |
| CN | 109563726 | A | | 4/2019 | |
| DE | 10-2010-040557 | A1 | | 3/2012 | |
| EP | 1338854 | A1 | * | 8/2003 | F25D 23/063 |
| EP | 3258194 | A1 | | 12/2017 | |
| GB | 890372 | A | * | 2/1962 | |
| JP | 2003106760 | A | * | 4/2003 | |
| JP | 2003-203763 | | | 7/2003 | |
| JP | 2005-127433 | A | | 5/2005 | |
| JP | 2007-063055 | | | 3/2007 | |
| JP | 2012-021615 | A | | 2/2012 | |
| JP | 5-242873 | B2 | | 7/2013 | |
| JP | 2014-162701 | | | 9/2014 | |
| JP | WO 2016/051787 | A1 | | 8/2017 | |
| KR | 101087395 | B1 | * | 11/2011 | F25D 23/06 |
| TW | 201736713 | A | | 10/2017 | |
| WO | WO 2008/105068 | | | 9/2008 | |
| WO | WO-2012176880 | A1 | * | 12/2012 | F25D 23/065 |

OTHER PUBLICATIONS

1st Office Action for JP Application No. 2022-537066 (6 pages).
Search Report for EP Application No. 20911944.5 dated Nov. 25, 2022 (4 pages).
1st Office Action for EP Application No. 20911944.5 dated Aug. 12, 2022 (7 pages).
Notice of Intent to Grant for EP Application No. 20911944.5 dated Apr. 17, 2023 (65 pages).

* cited by examiner

VACUUM ADIABATIC BODY AND REFRIGERATOR

CROSS-REFERENCE TO RELATED APPLICATIONS

The present application is a national phase entry of International Application No. PCT/CN2020/118856, filed Sep. 29, 2020, which claims priority to Chinese Patent Application No. 202010011081.0, filed Jan. 6, 2020, which are each incorporated herein by reference in their entirety.

FIELD OF THE INVENTION

The present invention relates to the technical field of refrigeration and freezing devices, and in particular to a vacuum adiabatic body and a refrigerator.

BACKGROUND OF THE INVENTION

In the conventional heat insulation methods of refrigerators, two methods are usually used, one is to provide a polyurethane foam layer, and the other is to use a vacuum adiabatic panel (i.e. VIP panel) with a polyurethane foam layer. Polyurethane foam has a high coefficient of thermal conductivity, but it needs to be arranged to a thickness of about 30 cm or more when used, thereby causing a reduction in the internal volume of the refrigerator. The vacuum degree of the vacuum adiabatic panel can only reach $10^{-2}$ Pa usually, and when used, the vacuum adiabatic panel needs to be embedded in the polyurethane foam layer, so that the process is complex, and the problem of a reduction of the internal volume of the refrigerator also exists.

BRIEF DESCRIPTION OF THE INVENTION

An object of the present invention is to provide a vacuum adiabatic body having a stable structure.

A further object of the present invention is to provide a vacuum adiabatic body having a good adiabatic effect.

In particular, the present invention provides a vacuum adiabatic body, including:

a first plate having a first thickness;

a second plate spaced apart from the first plate in an opposite manner, the second plate having a second thickness, and the first thickness being greater than the second thickness; and sealing members arranged between the first plate and the second plate and configured to seal and fix the first plate and the second plate, a vacuum cavity being defined among the first plate, the second plate and the sealing members.

Optionally, the first plate is made of a metal plate having a uniform thickness; and the second plate is made of a metal plate having a uniform thickness.

Optionally, the first plate is made of a stainless steel plate;

the second plate is made of a stainless steel plate; and the sealing members are made of quartz glass.

Optionally, the first thickness is 1.1 to 1.5 times the second thickness.

Optionally, the first thickness is 1.1 mm to 1.6 mm; and the second thickness is 1 mm to 1.5 mm.

Optionally, the sealing members are sandwiched between the first plate and the second plate, and are in surface contact with the first plate and the second plate respectively, so as to seal and fix the first plate and the second plate.

Optionally, the length of the sealing members sandwiched between the first plate and the second plate is 10 mm to 15 mm.

Optionally, the thickness of the sealing member satisfies that the thickness of the sealing member is 60% or more of a total distance between the first plate and the second plate.

Optionally, a nickel plating layer and a solder sheet are arranged between the sealing members and the first plate and between the sealing members and the second plate respectively, so as to achieve sealing and fixing of the sealing members to the first plate and the second plate, wherein the nickel plating layer is formed on an upper and a lower surface of the sealing members respectively, and the solder sheet is arranged between the nickel plating layer and the first plate and between the nickel plating layer and the second plate; or a metal sheet and a glass powder paste are arranged between the sealing members and the first plate and between the sealing members and the second plate respectively, so as to achieve sealing and fixing of the sealing members to the first plate and the second plate, wherein the metal sheet is arranged between the sealing members and the first plate and between the sealing members and the second plate respectively, and the glass powder paste is arranged between the sealing members and the metal sheet; or a silica gel layer is arranged between the sealing members and the first plate and between the sealing members and the second plate respectively, so as to achieve sealing and fixing of the sealing members to the first plate and the second plate.

The present invention further provides a refrigerator, and at least part of a box body of the refrigerator and/or at least part of a door body of the refrigerator is the foregoing vacuum adiabatic body.

According to the vacuum adiabatic body of the present invention, convective heat transfer may be reduced by vacuumizing between two plates sealingly connected; the two plates are sealed and fixed by the sealing members, so that the first plate and the second plate can always keep a certain distance, and the entire vacuum adiabatic body can be stable in structure and keep independent in appearance structure; the first plate has the first thickness, the second plate has the second thickness, the first thickness is greater than the second thickness; when the vacuum adiabatic body is used, the first plate is usually used as an outer side plate, the second plate is used as an inner side plate, so that a large first thickness can make the appearance of the vacuum adiabatic body less deformed, and improve the structural stability of the vacuum adiabatic body, and a small second thickness can reduce the weight of the vacuum adiabatic body.

Further, according to the vacuum adiabatic body of the present invention, the thickness of the two plates is defined, reducing a space occupied by the vacuum adiabatic body while ensuring an adiabatic effect, so that the vacuum adiabatic body is especially suitable for a built-in refrigerator.

Specific embodiments of the present invention will be described in detail below with reference to the accompanying drawings, and those skilled in the art will better understand the above and other objectives, advantages and features of the present invention.

BRIEF DESCRIPTION OF THE DRAWINGS

Hereinafter, some specific embodiments of the present invention will be described in detail in an exemplary rather than restrictive manner with reference to the accompanying drawings. In the accompanying drawings, like reference numerals denote like or similar components or parts. Those skilled in the art should understand that these accompanying drawings are not necessarily drawn to scale. In the figures.

DETAILED DESCRIPTION

In the following description, the orientations or positional relationships indicated by "front", "back", "upper", "lower", "left", "right", and the like are orientations based on the refrigerator 200 itself as a reference.

Figure 1:
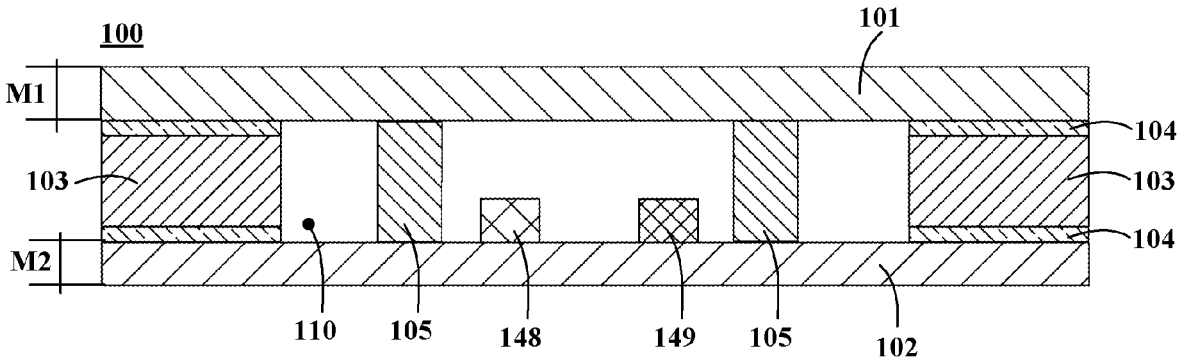
FIG. 1 is a schematic sectional view of a vacuum adiabatic body according to an embodiment of the present invention.
Figure 2:
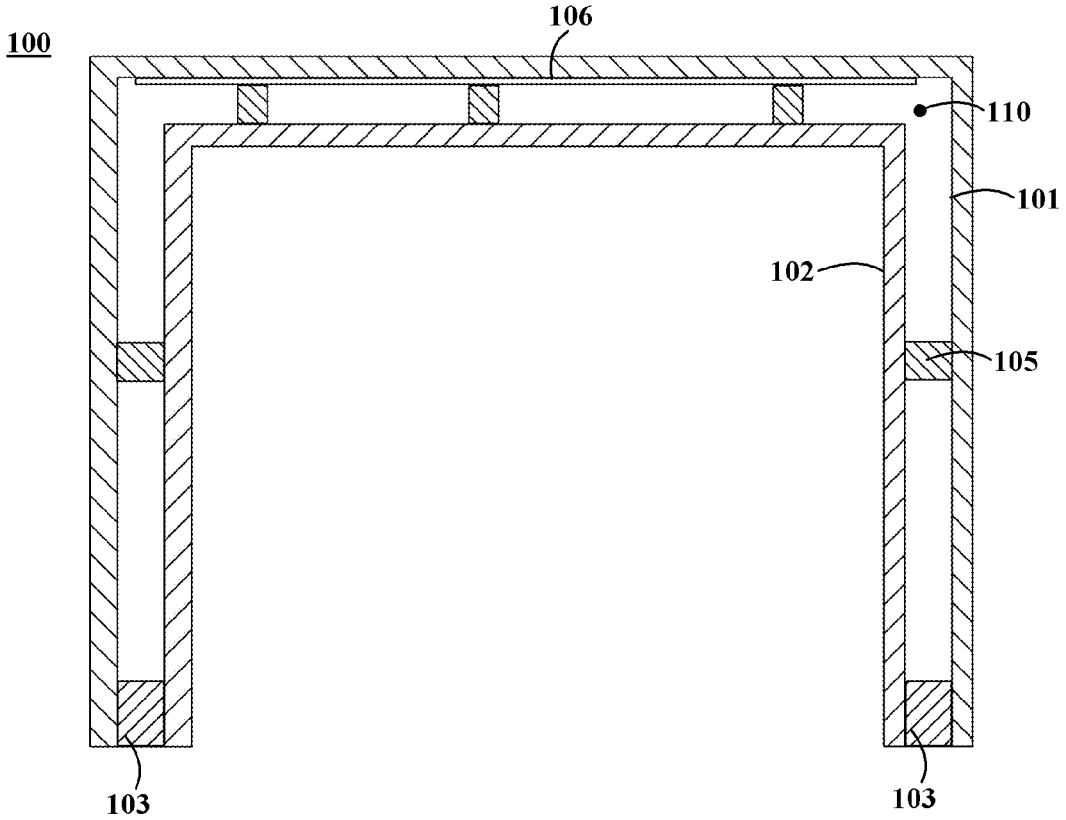
FIG. 2 is a schematic sectional view of a vacuum adiabatic body according to another embodiment of the present invention.

FIG. 1 is a schematic sectional view of a vacuum adiabatic body 100 according to an embodiment of the present invention. FIG. 2 is a schematic sectional view of a vacuum adiabatic body 100 according to another embodiment of the present invention. As shown in FIG. 1, according to an embodiment of the present invention, the vacuum adiabatic body 100 includes: a first plate 101, a second plate 102, and sealing members 103. The first plate 101 has a first thickness M1; the second plate 102 is arranged spaced apart from the first plate 101 in an opposite manner, the second plate 102 has a second thickness M2, and the first thickness M1 is greater than the second thickness M2. The sealing members 103 are arranged between the first plate 101 and the second plate 102 and are configured to seal and fix the first plate 101 and the second plate 102, and a vacuum cavity 110 is defined among the first plate 101, the second plate 102 and the sealing members 103. According to the vacuum adiabatic body 100 of the present invention, convective heat transfer may be reduced by vacuumizing between two plates sealingly connected; the two plates are sealed and fixed by the sealing members 103, so that the first plate 101 and the second plate 102 can always keep a certain distance, and the entire vacuum adiabatic body 100 may be stable in structure and keep independent in appearance structure. In general, when those skilled in the art face with adjusting the structure of the vacuum adiabatic body 100, the first plate 101 and the second plate 102 are simultaneously thinned or thickened. However, the applicant proposes that the first plate 101 has the first thickness M1, the second plate 102 has the second thickness M2, and the first thickness M1 is greater than the second thickness M2. When the vacuum adiabatic body 100 is used, the first plate 101 is usually used as an outer side plate, the second plate 102 is used as an inner side plate, so that a large first thickness M1 can make the appearance of the vacuum adiabatic body 100 less deformed, and improve the structural stability of the entire vacuum adiabatic body 100, and a small second thickness M2 can reduce the weight of the vacuum adiabatic body 100. The vacuum adiabatic body 100 can be applied to a refrigeration and freezing device, in particular an air-cooled refrigerator. The vacuum degree of the vacuum cavity 110 of the vacuum adiabatic body 100 of the present invention is $10^{-1}$ to $10^{-3}$ Pa.

In the present application, the second plate 102 is arranged spaced apart from the first plate 101 in an opposite manner, including two scenarios. One is that the second plate 102 and the main body surface of the first plate 101 are substantially parallel to each other, and when the vacuum adiabatic body 100 is placed horizontally, a longitudinal sectional view thereof is shown as FIG. 1. Another is that the first plate 101 is in a cuboid shape with an opening on a surface, and through the opening, the second plate 102 is arranged in the first plate 101 in a profiling and sleeving manner at an interval, and a cross sectional view thereof at the opening is shown as FIG. 2.

In some embodiments, the first thickness M1 is 1.1 to 1.5 times the second thickness M2. The first thickness M1 is 1.1 mm to 1.6 mm; and the second thickness M2 is 1 mm to 1.5 mm. For example, the first thickness M1 is 1.1 mm, and the second thickness M2 is 1 mm. For another example, the first thickness M1 is 1.5 mm, and the second thickness M2 is 1 mm. In fact, prior to the present invention, when facing a problem of ensuring an adiabatic effect, those skilled in the art generally increase the thickness of the two layers, for example, using a plate having a thickness greater than 10 mm. However, the applicant creatively realizes that the thickness of the two layers is not the greater the better, design schemes for increasing the thickness of the plates may cause a problem that the whole weight of the vacuum adiabatic body 100 may be too heavy, thereby causing an adverse effect on a use of the vacuum adiabatic body 100. In addition, when the vacuum adiabatic body 100 is applied to the refrigerator 200, a problem of a reduction of the internal volume of the refrigerator 200 may exist. Therefore, the applicant gets rid of conventional design ideas, creatively proposes to define the thickness of the two plates, so as to reduce a space occupied by the vacuum adiabatic body 100 while ensuring the adiabatic effect.

In some embodiments, the first plate 101 is made of a metal plate having a uniform thickness; and the second plate 102 is made of a metal plate having a uniform thickness. The two plates are made of a metal plate, so that the vacuum adiabatic body 100 may be stable in structure. Preferably, the first plate 101 is made of a stainless steel plate; the second plate 102 is made of a stainless steel plate; and the sealing members 103 are made of quartz glass. The first plate 101 and the second plate 102 may be a stainless steel plate having an inner surface being a mirror surface or an evaporation surface. Such as a 304 stainless steel. By using the stainless steel plate, the strength of the vacuum adiabatic body 100 can be ensured, the appearance can keep beautiful, radiation heat transfer may be reduced, and a gas leakage caused by corrosion and tarnishing can be avoided. The sealing members 103 use the quartz glass, has characteristics of a low thermal conductivity and a low outgassing rate, and can solve a problem of thermal bridge heat transfer of the vacuum adiabatic body 100.

In some embodiments, sealing members 103 are sandwiched between the first plate 101 and the second plate 102, and are in surface contact with the first plate 101 and the second plate 102 respectively, so as to seal and fix the first plate 101 and the second plate 102. For example, in the vacuum adiabatic body 100 shown in FIG. 1, the sealing members 103 are block-shaped members. For another example, in the vacuum adiabatic body 100 shown in FIG. 2, the sealing members 103 are square annular members having a certain thickness in a front-back direction. According to the vacuum adiabatic body 100 of the present invention, by using the sealing members 103 being sandwiched between the first plate 101 and the second plate 102, and forming surface contact respectively to seal and fix the first plate 101 and the second plate 102, so that a structural stability of the entire vacuum adiabatic body 100 can be improved, and the sealing part is not easily damaged, and the vacuum cavity 110 can continuously keep stable in vacuum state. In some embodiments, the length of the sealing members 103 sandwiched between the first plate 101 and the second plate 102 is 10 mm to 15 mm, such as 10 mm, 12 mm, and 15 mm. According to a plurality of experimental studies, the length of the sealing members 103 between the first plate 101 and the second plate 102 is preferably limited at the range of 10 mm to 15 mm, thereby ensuring a tight sealing of the sealing members 103 to the first plate 101 and the second plate 102, and preventing the volume of the vacuum cavity 110 from reduction due to the sealing members 103 with too large size, so that the vacuum adiabatic body 100 is good in adiabatic effect.

In some embodiments, the thickness of the sealing member 103 satisfies that the thickness of the sealing member 103 is 60% or more of a total distance between the first plate 101 and the second plate 102. That is, the sealing members 103 are members having a certain thickness, when the thickness of the sealing member 103 is 60% or more of a total distance between the first plate 101 and the second plate 102, the structural stability of the entire vacuum adiabatic body 100 can be improved. The distance between the first plate 101 and the second plate 102 is 0.5 mm to 20 mm, such as 0.5 mm, 2 mm, 5 mm, 10 mm, 15 mm, and 20 mm. By arranging an interval between the first plate 101 and the second plate 102 to be 0.5 mm-20 mm, different thermal insulation and product requirements can be satisfied.

Figure 3:
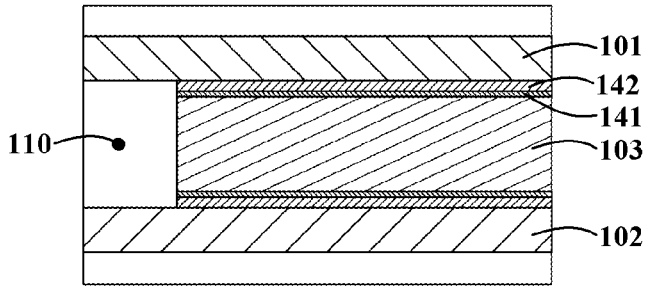
FIG. 3 is a schematic diagram of a cooperation of sealing members with a first plate and a second plate of the vacuum adiabatic body shown in FIG. 1.
Figure 4:
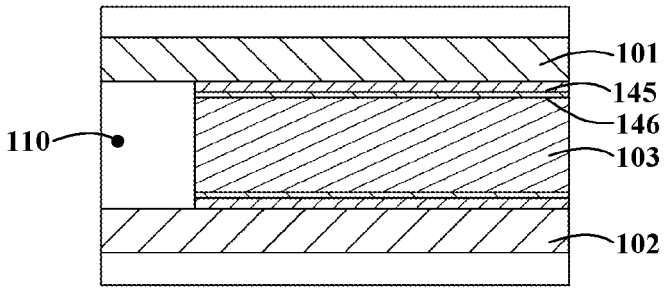
FIG. 4 is another schematic diagram of a cooperation of sealing members with a first plate and a second plate of the vacuum adiabatic body shown in FIG. 1.
Figure 5:
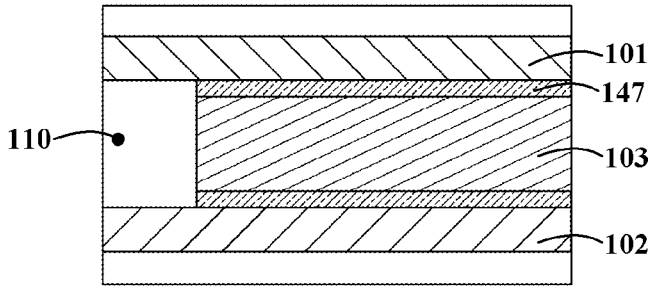
FIG. 5 is still another schematic diagram of a cooperation of sealing members with a first plate and a second plate of the vacuum adiabatic body shown in FIG. 1.

As shown in FIG. 1, sealing structures 104 are arranged between the sealing members 103 and the first plate 101 and between the sealing members 103 and the second plate 102 respectively, so as to achieve sealing and fixing of the sealing members 103 to the first plate 101 and the second plate 102. The sealing structures 104 are arranged between the sealing members 103 and the two plates respectively to seal and fix, so that the sealing members 103, the first plate 101 and the second plate 102 can be firmly sealed. FIG. 3 is a schematic diagram of a cooperation of the sealing members 103 and the first plate 101 and the second plate 102 of the vacuum adiabatic body 100 shown in FIG. 1. FIG. 4 is another schematic diagram of a cooperation of the sealing members 103 and the first plate 101 and the second plate 102 of the vacuum adiabatic body 100 shown in FIG. 1. FIG. 5 is still another schematic diagram of a cooperation of the sealing members 103 and the first plate 101 and the second plate 102 of the vacuum adiabatic body 100 shown in FIG. 1.

Because a thermal expansion coefficient of quartz glass and a stainless steel plate is 15 times different, the sealing structure 104 needs to be elastic, and to be tightly combined with the quartz glass and the stainless steel plate, so that a tight connection between the quartz glass and the stainless steel plate can be ensured.

As shown in FIG. 3, the sealing structure 104 includes a nickel plating layer 141 and a solder sheet 142; the nickel plating layer 141 is formed on an upper and a lower surface of the sealing members 103 respectively, and the solder sheet 142 is arranged between the nickel plating layer 141 and the first plate 101 and between the nickel plating layer 141 and the second plate 102; and by welding the nickel plating layer 141 and the solder sheet 142, the sealing members 103 can be sealed and fixed with the first plate 101 and the second plate 102.

By forming the nickel plating layer 141 on the upper surface and the lower surface of the sealing members 103 respectively, and arranging the solder sheet 142 between the nickel plating layer 141 and the first plate 101 and between the nickel plating layer 141 and the second plate 102, the sealing members 103 are sealed and fixed with the first plate 101 and the second plate 102, so that the sealing members 103 can be tightly sealed with the first plate 101 and the second plate 102, and a gas leakage caused by insufficient sealing can be avoided. The thickness of the nickel plating layer 141 is 1 μm to 2 μm; the thickness of the solder sheet 142 is 0.08 mm to 0.12 mm, such as 0.1 mm. The thickness of nickel plating layer 141 is 1 μm to 2 μm so as to meet the needs of adhesion and metal welding. The thickness of the solder sheet 142 is 0.08 mm to 0.12 mm so as to both ensure welding strength and avoid thermal conduction.

A manufacturing method for the vacuum adiabatic body 100 includes the steps:

a nickel plating processing is performed on the sealing members 103 to form the nickel plating layer 141 on the upper surface and the lower surface of the sealing members 103;

the sealing members 103 are sandwiched between the first plate 101 and the second plate 102, and the solder sheet 142 is placed between the nickel plating layer 141 and the first plate 101 and between the nickel plating layer 141 and the second plate 102 respectively, so as to obtain a to-be-processed member; and a welding and sealing processing and a vacuumizing processing are performed on the to-be-processed member to obtain the vacuum adiabatic body 100.

According to the manufacturing method, the difference of thermal expansion coefficient between the quartz glass and the stainless steel plate is fully considered; the nickel plating processing is performed on the quartz glass of the sealing members 103, and the solder sheet 142 is placed between the nickel plating layer 141 and the first plate 101 and between the nickel plating layer 141 and the second plate 102 respectively, and finally the welding and sealing processing and the vacuumizing processing are performed, a tight connection between the quartz glass and the metal plate is ensured, so that the vacuum cavity 110 may keep stable in vacuum state, and a gas leakage caused by insufficient sealing is avoided.

A nickel plating processing on the sealing members 103 can be performed by a method of nickel plating on the quartz glass disclosed in the prior art. For example, firstly a preprocessing is performed on the quartz glass of the sealing members 103, and then a chemical plating processing is performed by using a chemical plating solution. The preprocessing includes the steps of: removing a protective layer, degreasing, coarsening, sensitizing, activating and a heat treatment; the used chemical plating solution is a mixed solution composed of a nickel salt, a reducing agent, a buffer agent, a complexing agent and the like; the preprocessed bare sealing members 103 are performed the chemical plating for a certain time in the prepared chemical plating solution at the temperature of 80° C. to 90° C., and then rinsed with a deionized water to complete nickel plating on the sealing members 103.

The solder sheet 142 may be a silver-copper solder sheet, Ag:Cu=72:28.

The welding and sealing processing and the vacuumizing processing of the to-be-processed member are performed in a vacuum furnace. In some embodiments, the steps of performing the welding and sealing processing and the vacuumizing processing on the to-be-processed member are: the to-be-processed member is vacuumized first, and then is welded and sealed. In other embodiments, the steps of performing the welding and sealing processing and the vacuumizing processing on the to-be-processed member are: the to-be-processed member is welded and sealed first, and then vacuumized. The welding temperature of the welding and sealing processing is 750° C. to 850° C., such as 800° C. After the welding and sealing processing is completed, the temperature is maintained for 1 min to 2 min, and then the vacuum adiabatic body 100 is taken out of the vacuum furnace. The vacuumizing processing is to vacuumize to a vacuum degree of $10^{-1}$ to $10^{-3}$ Pa.

The steps of vacuumizing the to-be-processed member first, and then welding and sealing include:

the air between the first plate 101 and the second plate 102 is extracted through a gap between the sealing members 103, the solder sheet 142 and the first plate 101 and the second plate 102; and the sealing members 103 are welded and sealed with the first plate 101 and the second plate 102.

Figure 6:
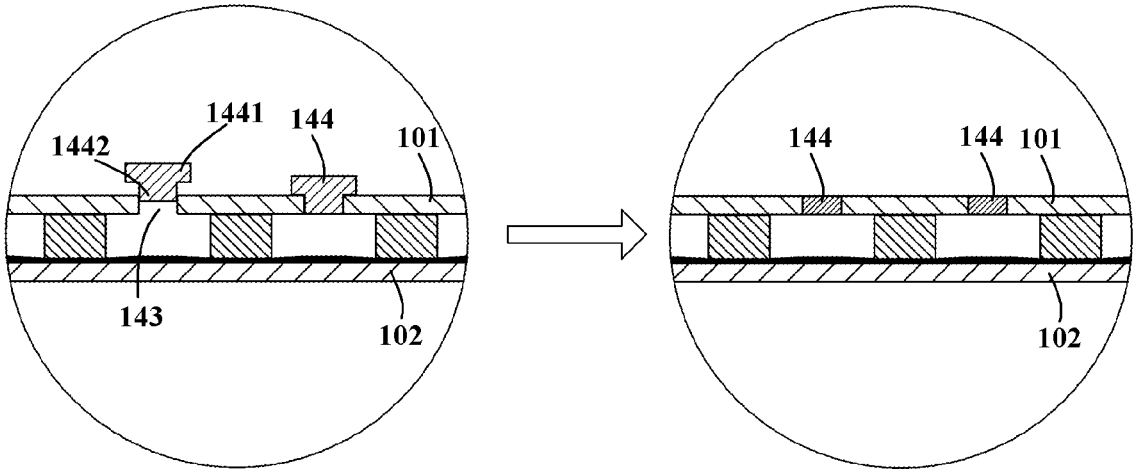
FIG. 6 is a schematic diagram of an application of a brazing sheet of the vacuum adiabatic body shown in FIG. 1.

The first plate 101 and/or the second plate 102 are provided with a plurality of air extraction holes 143; a brazing sheet 144 is placed in each of the air extraction holes 143. FIG. 6 is a schematic diagram of the application of a brazing sheet 144 of the vacuum adiabatic body 100 shown in FIG. 1, in which the left side is a schematic diagram of placing the brazing sheet 144 into the air extraction holes 143, and the right side thereof is a schematic diagram of after heating and melting the brazing sheet 144 after vacuumizing. The brazing sheet 144 has a body portion 1441 and a protrusion portion 1442; the body portion 1441 covers an outer surface of the air extraction holes 143; the protrusion portion 1442 is inserted into the air extraction holes 143 and there is a gap between the protrusion portion 1442 and the air extraction holes 143. The brazing sheet 144 may be a tin solder material. The diameter of the air extraction holes 143 is about 5 to 10 mm, and 3 to 5 air extraction holes are provided in each square meter. The steps of welding and sealing the to-be-processed member first, and then vacuumizing includes:

the sealing members 103 are welded and sealed with the first plate 101 and the second plate 102, so as to define a cavity between the sealing members 103, the first plate 101 and the second plate 102;

the air in the cavity is extracted through the gap between the brazing sheet 144 and the air extraction holes 143; and the brazing sheet 144 is heated to melt so as to seal the air extraction holes 143.

As shown in FIG. 4, in other embodiments, the sealing structure 104 includes a metal sheet 145 and a glass powder paste 146; the metal sheet 145 is arranged between the sealing members 103 and the first plate 101 and between the sealing members 103 and the second plate 102 respectively, the glass powder paste 146 is arranged between the sealing members 103 and the metal sheet 145; the sealing members 103 are sealed and fixed with the first plate 101 and the second plate 102 by melting the glass powder paste 146 and welding the metal sheet 145. The glass powder paste 146 is used to fix the metal sheet 145 on the surface of the sealing members 103, and then the metal sheet 145 is used to achieve sealing and fixing of the sealing members 103 to the first plate 101 and the second plate 102, so that the sealing members 103 are tightly sealed with the first plate 101 and the second plate 102, and a gas leakage caused by insufficient sealing is avoided. The metal sheet 145 may use a metal strip. The metal sheet 145 is made of a material capable of making up the difference of thermal expansion coefficient between the quartz glass and the stainless steel plate. The material of the metal sheet 145 is Kovar alloy, such as chromium-iron alloy, iron-nickel-cobalt alloy.

A manufacturing method for the vacuum adiabatic body 100 includes the steps:

the metal sheet 145 is fixed on the upper and lower surfaces of the sealing members 103 respectively to obtain a composite member;

the composite member is sandwiched between the first plate 101 and the second plate 102 to obtain a to-be-processed member; and a welding and sealing processing and a vacuumizing processing are performed on the to-be-processed member to obtain the vacuum adiabatic body 100.

According to the manufacturing method for the vacuum adiabatic body 100, the metal sheet 145 is fixed on the upper and lower surfaces of the sealing members 103, then the composite member is sandwiched between the first plate 101 and the second plate 102, and finally the welding and sealing processing and the vacuumizing processing are performed, thereby ensuring the sealing members 103 is tightly connected to the first plate 101 and the second plate 102, so that the vacuum cavity 110 can keep stable in vacuum state, and a gas leakage caused by insufficient sealing can be avoided.

The composite member is obtained by coating the glass powder paste 146 on the metal sheet 145, and then attaching the metal sheet 145 to the surface of the sealing members 103, and heating and melting. The temperature of heating and melting is 440° C. to 460° C., which can melt a paste, but cannot melt glass. According to the manufacturing method, the Kovar alloy metal sheet 145 and the sealing members 103 are fixed by using the glass powder paste 146, and then the composite member is fixed with the first plate 101 and the second plate 102, the difference of the thermal expansion coefficient between quartz glass and the stainless steel plate is fully considered, a tight connection between the quartz glass and the stainless steel plate is ensured, so that the vacuum cavity 110 can keep stable in vacuum state, and a gas leakage caused by insufficient sealing can be avoided.

Similarly, the welding and sealing processing and the vacuumizing processing on the to-be-processed member are performed in a vacuum furnace. In some embodiments, the steps of performing the welding and sealing processing and the vacuumizing processing on the to-be-processed member are: the to-be-processed member is vacuumized first, and then is welded and sealed. In other embodiments, the steps of performing the welding and sealing processing and the vacuumizing processing on the to-be-processed member are: the to-be-processed member is welded and sealed first, and then vacuumized. The welding temperature of the welding and sealing processing is 750° C. to 850° C., such as 800° C. After the welding and sealing processing is completed, the temperature is maintained for 1 min to 2 min, and then the vacuum adiabatic body 100 is taken out of the vacuum furnace. The vacuumizing processing is to vacuumize to a vacuum degree of $10^{-1}$ to $10^{-3}$ Pa.

The steps of vacuumizing the to-be-processed member first, and then welding and sealing include:

the air between the first plate 101 and the second plate 102 is extracted through the gap between the metal sheet 145 and the first plate 101 and between the metal sheet 145 and the second plate 102; and the composite member is welded and sealed with the first plate 101 and the second plate 102.

The first plate 101 and/or the second plate 102 are provided with a plurality of air extraction holes 143; as shown in FIG. 6, the brazing sheet 144 is placed in each of the air extraction holes 143. The brazing sheet 144 has the body portion 1441 and the protrusion portion 1442; the body portion 1441 covers an outer surface of the air extraction holes 143; the protrusion portion 1442 is inserted into the air extraction holes 143 and there is a gap between the protrusion portion 1442 and the air extraction holes 143. The brazing sheet 144 may be a tin solder material. The diameter of the air extraction holes 143 is about 5 to 10 mm, and 3 to 5 air extraction holes are provided in each square meter. The steps of welding and sealing the to-be-processed member first, and then vacuumizing includes:

the composite member is welded and sealed with the first plate 101 and the second plate 102, so as to define a cavity between the composite member and the first plate 101 and the second plate 102;

the air in the cavity is extracted through the gap between the brazing sheet 144 and the air extraction holes 143; and the brazing sheet 144 is heated to melt so as to seal the air extraction holes 143.

As shown in FIG. 5, in other embodiments, a sealing structure 104 includes a silica gel layer 147; the silica gel layer 147 is arranged between the sealing members 103 and the first plate 101 and between the sealing members 103 and the second plate 102 respectively; the sealing members 103 is sealed and fixed with the first plate 101 and the second plate 102 by bonding the silica gel layer 147. To achieve the sealing and fixing of the sealing members 103 with the first plate 101 and the second plate 102, so that the sealing members 103 is tightly sealed with the first plate 101 and the second plate 102, and a gas leakage caused by insufficient sealing is avoided.

The silica gel is a quick-drying silica gel, has the strength performance of a structural adhesive and the toughness of the silica gel, is good in air tightness, and can be tightly combined with the quartz glass and the stainless steel plate. In other embodiments, the thickness of the silica gel layer 147 is 0.3 mm to 0.7 mm, such as 0.3 mm, 0.5 mm, and 0.7 mm. The thickness of the silica gel layer 147 is 0.3 mm to 0.7 mm so as to ensure structural strength, toughness, heat insulation and outgassing.

The first plate 101 and/or the second plate 102 are provided with a plurality of air extraction holes 143; as shown in FIG. 6, the brazing sheet 144 is placed in each of the air extraction holes 143. The brazing sheet 144 has the body portion 1441 and the protrusion portion 1442; the body portion 1441 covers an outer surface of the air extraction holes 143; the protrusion portion 1442 is inserted into the air extraction holes 143 and there is a gap between the protrusion portion 1442 and the air extraction holes 143. The brazing sheet 144 may be a tin solder material. The diameter of the air extraction holes 143 is about 5 to 10 mm, and 3 to 5 air extraction holes are provided in each square meter. A manufacturing method for the vacuum adiabatic body 100 includes the steps:

a quick-drying silica gel is coated on an upper and a lower surfaces of the sealing members 103 to form a silica gel layer 147;

the sealing members 103 are sandwiched between the first plate 101 and the second plate 102, and then is pressed and fixed, so as to define a cavity between the sealing members 103, the first plate 101 and the second plate 102; a pressing time is calculated according to a pressing area, generally being about 10 min;

the air in the cavity is extracted through the gap between the brazing sheet 144 and the air extraction holes 143, where a vacuum degree of the vacuumizing is between $10^{-1}$ to $10^{-3}$ Pa; and the brazing sheet 144 is heated to melt so as to seal the air extraction holes 143.

Regarding gas molecules adsorbed on the surface of the first plate 101 and the second plate 102, as shown in FIG. 1, in some embodiments, a getter 148 is arranged in the vacuum cavity 110 to continuously absorb the released gas. The getter 148 can absorb $O_2$, $H_2$, $N_2$, $CO_2$, CO, etc. Regarding moisture adsorbed on the surface of the first plate 101 and the second plate 102 (the water has a high freezing point temperature at low pressure and condenses into ice), heating is performed outside the entire component, so that water molecules are fully sublimated to be extracted. At the same time, a moisture absorbent 149 is placed in the vacuum cavity 110 to continuously absorb the released moisture. The heating of the component is at a temperature of 120° C. to 140° C. For those skilled in the art, the getter 148 and the moisture absorbent 149 may be made of materials that may provide the foregoing effects in the prior art, and will not be described in detail herein.

As shown in FIG. 1, in some embodiments, the vacuum adiabatic body 100 further includes: a plurality of support members 105 arranged in the vacuum cavity 110 and configured to be fixed with the first plate 101 and/or the second plate 102, so as to provide support between the first plate 101 and the second plate 102. By arranging a plurality of support members 105 in the vacuum cavity 110, a support to the first plate 101 and the second plate 102 is provided, thereby enhancing the strength of the entire vacuum adiabatic body 100; by directly fixing the support members 105 and the first plate 101 and/or the second plate 102, an arranging process of the support members 105 is simplified, so that a manufacturing process of the entire vacuum adiabatic body 100 is simplified. When the deformation amount is tested under the condition of $5*10^{-3}$ Pa negative pressure, the deformation amount of the vacuum adiabatic body 100 of the present invention is less than 0.5 mm. In the present invention, the "deformation amount" refers to the amount of a distance reduction between the first plate 101 and the second plate 102.

The distance between the first plate 101 and the second plate 102 is 2 mm to 20 mm, for example, when the distance is 2.5 mm, 5 mm, 10 mm, 15 mm, and 20 mm, the support members 105 are preferably made of the quartz glass or a polytetrafluoroethylene. The quartz glass or the polytetrafluoroethylene is low in thermal conductivity and outgassing rate, so that a heat conduction can be reduced, and at the same time, the quartz glass or the polytetrafluoroethylene is high in strength, so that the entire vacuum adiabatic body 100 can be stable in structure. The support member 105 is more preferably made of the quartz glass, and the quartz glass does not release gas and is beneficial to maintaining the vacuum degree of the vacuum cavity 110.

Figure 14:
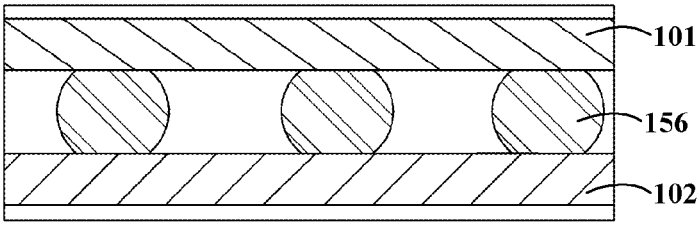
FIG. 14 is a sixth partial structural schematic diagram of the vacuum adiabatic body shown in FIG. 1.
Figure 15:
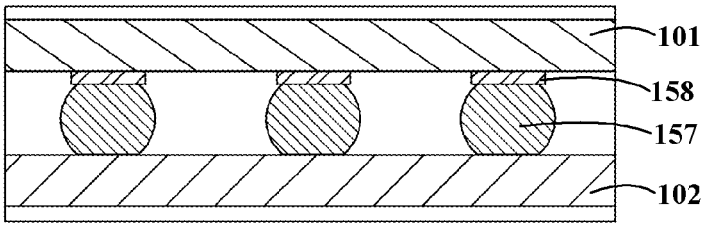
FIG. 15 is a seventh partial structural schematic diagram of the vacuum adiabatic body shown in FIG. 1.

The distance between the first plate 101 and the second plate 102 is 0.5 mm to 2 mm, such as 0.5 mm, 1 mm, and 2 mm, the support member 105 may be a point-like ceramic 156 or a glass micro-sphere 157. FIG. 14 is a sixth partial structural schematic diagram of the vacuum adiabatic body 100 shown in FIG. 1, and the support member 105 is the point-like ceramic 156. FIG. 15 is a seventh partial structural schematic diagram of the vacuum adiabatic body 100 shown in FIG. 1, and the support member 105 is the glass micro-sphere 157.

The present invention proposes to provide different support members 105 according to different distances between the first plate 101 and the second plate 102, so that different thermal insulation and product requirements can be satisfied. The point-like ceramic 156 is formed by dotting a ceramic paste on the first plate 101 and/or the second plate 102. The glass micro-sphere 157 may be bonded and fixed with the first plate 101 and/or the second plate 102. The glass micro-sphere 157 may be bonded and fixed by using a silica gel 158 to bond and fix. It should be noted that, in FIG. 1 and FIG. 2, reference numeral 105 represents various types of support members. In FIGS. 8, 9, 10, 12, and 13, the distance between the first plate 101 and the second plate 102 is greater than 2 mm, and the reference numeral 105 represents the a quartz glass or a polytetrafluoroethylene support member.

Figure 7:
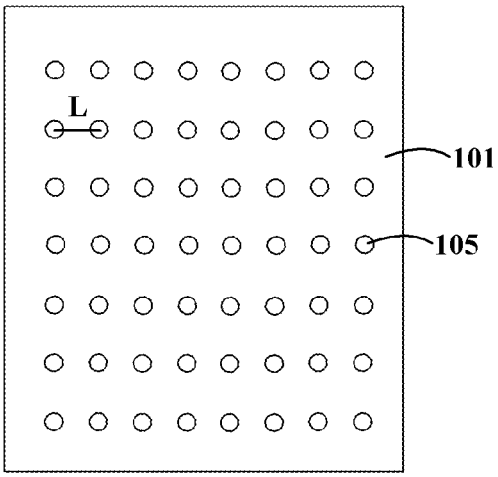
FIG. 7 is a schematic diagram of the distribution of a support member of the vacuum adiabatic body shown in FIG. 1.
Figure 8:
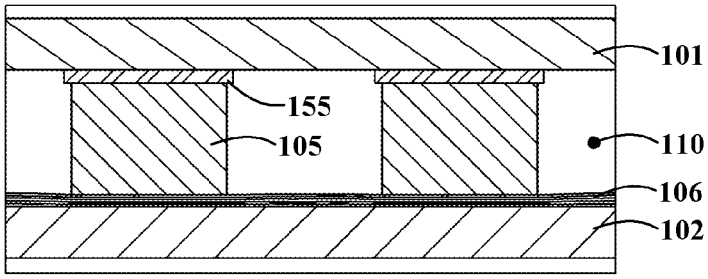
FIG. 8 is a first partial structural schematic diagram of the vacuum adiabatic body shown in FIG. 1.
Figure 9:
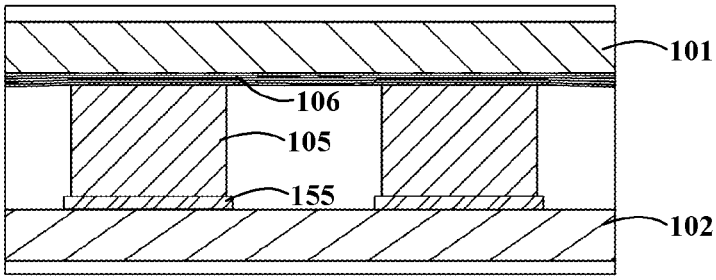
FIG. 9 is a second partial structural schematic diagram of the vacuum adiabatic body shown in FIG. 1.

FIG. 7 is a schematic diagram of the distribution of the support member 105 of the vacuum adiabatic body 100 shown in FIG. 1. FIG. 8 is a first partial structural schematic diagram of the vacuum adiabatic body 100 shown in FIG. 1, and a plurality of support members 105 are all fixed with the first plate 101. FIG. 9 is a second partial structural schematic diagram of the vacuum adiabatic body 100 shown in FIG. 1, and a plurality of support members 105 are all fixed with the second plate 102. In some embodiments, as shown in FIG. 8 and FIG. 9, an epoxy resin layer or a silica gel layer 155 is arranged between the support members 105 and the first plate 101 and/or the second plate 102, so as to fix the support members 105 to the first plate 101 and/or the second plate 102. By applying epoxy resin or silica gel on the quartz glass or the polytetrafluoroethylene, the support member 105 is adhered and fixed with the first plate 101 and/or the second plate 102 in a tightly pressed manner, so that a stable fixation can be ensured. As shown in FIG. 8, the support member 105 has a columnar structure. In some embodiments, the diameter of the columnar structure of the support member 105 is 10 mm to 20 mm. The distance L between adjacent support members 105 is 30 mm to 50 mm. Optimization based on the simulation calculation is that, when the diameter of the columnar structure of the support member 105 is arranged to be 10 mm to 20 mm, and the distance between the adjacent support members 105 is arranged to be 30 mm to 50 mm, a minimum contact area may be achieved on the premise of ensuring the requirement of deformation amount, so as to reduce the heat transfer of the first plate 101 and the second plate 102.

Figure 10:
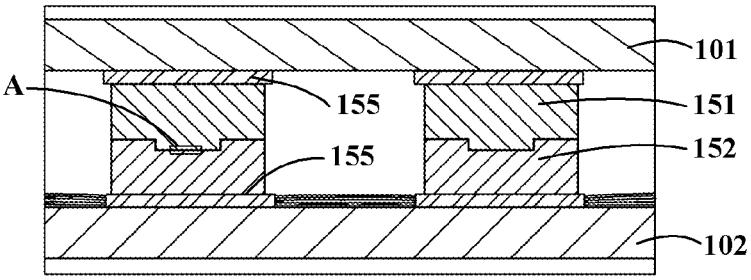
FIG. 10 is a third partial structural schematic diagram of the vacuum adiabatic body shown in FIG. 1.
Figure 11:
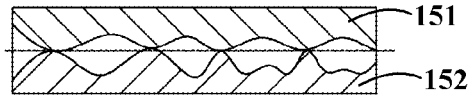
FIG. 11 is a schematic diagram of a contact part of a first support portion and a second support portion, and is also a partial enlarged view of part A in FIG. 10.

FIG. 10 is a third partial structural schematic diagram of the vacuum adiabatic body 100 shown in FIG. 1. FIG. 11 is a schematic diagram of a contact part of a first support portion 151 and a second support portion 152, and is also a partial enlarged view of part A in FIG. 10. In some embodiments, the support member 105 includes: the first support portion 151 and the second support portion 152. The first support portion 151 is fixed with a first plate 101. The second support portion 152 is fixed with a second plate 102. The first support portion 151 and the second support portion 152 are arranged in an opposite manner, and surfaces thereof are in contact with each other. By configuring the support member 105 to include the first support portion 151 and the second support portion 152 arranged opposite to each other, a thermal resistance can be improved. In an embodiment, the surface of the first support portion 151 is formed with a recessed portion; the second support portion 152 is formed with a protrusion portion corresponding to the recessed portion; and the recessed portion and the protrusion portion are jointed in a matching manner. Preferably, the first support portion 151 and the second support portion 152 are in a multi-point contact, as shown in FIG. 11. In the middle of the first support portion 151 and the second support portion 152, micro-point contact is formed, thereby reducing heat transfer.

When the support member 105 is arranged in the vacuum adiabatic body 100, the support member 105 is firstly fixed and then sealed.

Figure 16:
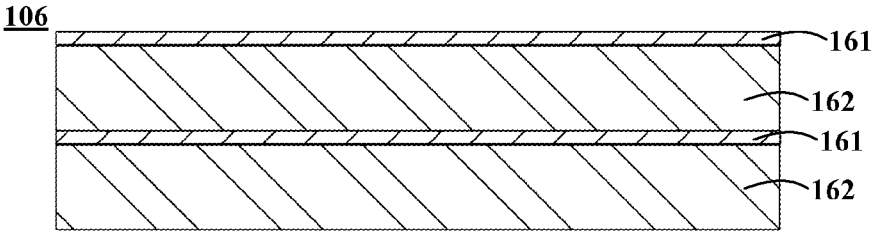
FIG. 16 is a structural schematic diagram of the multilayer adiabatic film of the vacuum adiabatic body shown in FIG. 1.

As shown in FIG. 8 to FIG. 13, in some embodiments, a vacuum adiabatic body 100 further includes: a multi-layer adiabatic film 106 arranged in the vacuum cavity 110, including an aluminum foil 161 and a glass fiber membrane 162 alternately stacked and used for reducing a thermal radiation of the first plate 101 and the second plate 102 through the vacuum cavity 110. By arranging the multi-layer adiabatic film 106 in the vacuum cavity 110, the thermal radiation of the first plate 101 and the second plate 102 through the vacuum cavity 110 can be reduced. The multi-layer adiabatic film 106 includes the aluminum foil 161 and the glass fiber membrane 162 alternately stacked, by using the glass fiber membrane 162 to isolate the aluminum foil 161, a decrease of the thermal adiabatic performance caused by a attaching of the aluminum foil 161 can be avoided. The thickness of the aluminum foil 161 may be 8 μm to 10 μm; and the thickness of the glass fiber membrane 162 may be 0.4 mm to 0.6 mm. FIG. 16 is a structural schematic diagram of the multi-layer adiabatic film 106 of the vacuum adiabatic body 100 shown in FIG. 1.

In some embodiments, a distance between a first plate 101 and a second plate 102 is 2 mm to 20 mm, such as 3 mm, 5 mm, 10 mm, 15 mm, and 20 mm; the total number of layers of the multi-layer adiabatic film 106 is 3 to 8 layers, such as 3 layers, 5 layers, and 8 layers. By arranging different layers of heat adiabatic films 106 according to the different distances between the first plate 101 and the second plate 102, different heat insulation and product requirements can be satisfied. An outermost layer of the multi-layer adiabatic film 106 may be the aluminum foil 161 or the glass fiber membrane 162.

In some embodiments, as shown in FIG. 8, one end of a plurality of support members 105 is fixed with the first plate 101, and the other end has a gap between the second plate 102. The multi-layer adiabatic film 106 is configured to be arranged through the gap in a passing manner, and the support member 105 and a plurality of the multi-layer adiabatic films 106 are in cooperation between the first plate 101 and the second plate 102 to provide support. As shown in FIG. 9, one end of a plurality of the support members 105 is fixed with the second plate 102, a gap is formed between the another end and the first plate 101, the multi-layer adiabatic film 106 is configured to pass through the gap, and the support member 105 and the multi-layer adiabatic film 106 are in the cooperation between the first plate 101 and the second plate 102 to provide support.

Figure 12:
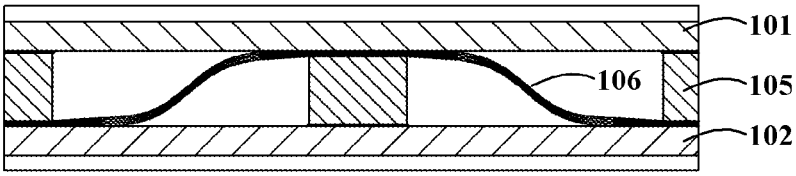
FIG. 12 is a fourth partial structural schematic diagram of the vacuum adiabatic body shown in FIG. 1.
Figure 13:
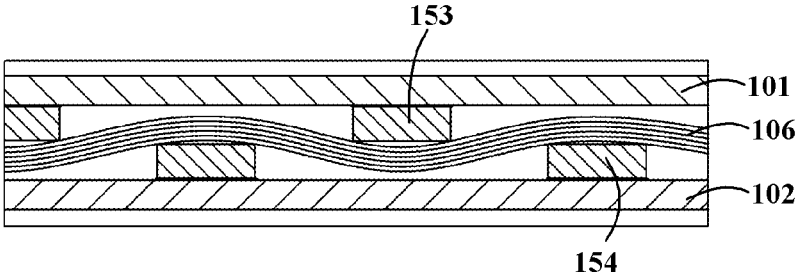
FIG. 13 is a fifth partial structural schematic diagram of the vacuum adiabatic body shown in FIG. 1.

FIG. 12 is a fourth partial structural schematic diagram of the vacuum adiabatic body 100 shown in FIG. 1, a part of a support member 105 is fixed with a first plate 101 and is named a first support member 153; and a part of the support member 105 is fixed with a second plate 102 and is named a second support member 154. FIG. 13 is a fifth partial structural schematic diagram of the vacuum adiabatic body 100 shown in FIG. 1. In other embodiments, the support member 105 includes the first support member 153 and the second support member 154. One end of the first support member 153 is fixed with a first plate 101, and a first gap is formed between the other end and the second plate 102. One end of the second support member 154 is fixed with a second plate 102, and a second gap is formed between the other end and the first plate 101. The first support member 153 and the second support member 154 are staggered from each other, and the multi-layer adiabatic film 106 is configured to pass through the first gap and the second gap. As shown in FIG. 12, the first support member 153 and the second support member 154 respectively cooperate with the multi-layer adiabatic film 106 to provide support between the first plate 101 and the second plate 102. As shown in FIG. 13, the first support member 153, the second support member 154 cooperate with the multi-layer adiabatic film 106 to provide support between the first plate 101 and the second plate 102.

When the multi-layer adiabatic film 106 is arranged in the vacuum adiabatic body 100, the multi-layer adiabatic film 106 is firstly fixed and then sealed. When the multi-layer adiabatic film 106 and the support member 105 are arranged in the vacuum adiabatic body 100, the support member 105 is firstly fixed, then the multi-layer adiabatic film 106 is arranged, and finally a sealing is performed.

The vacuum adiabatic body 100 of the present invention solves problems of heat transfer, supporting and sealing, so that the vacuum adiabatic body 100 can be actually produced and applied.

Figure 17:
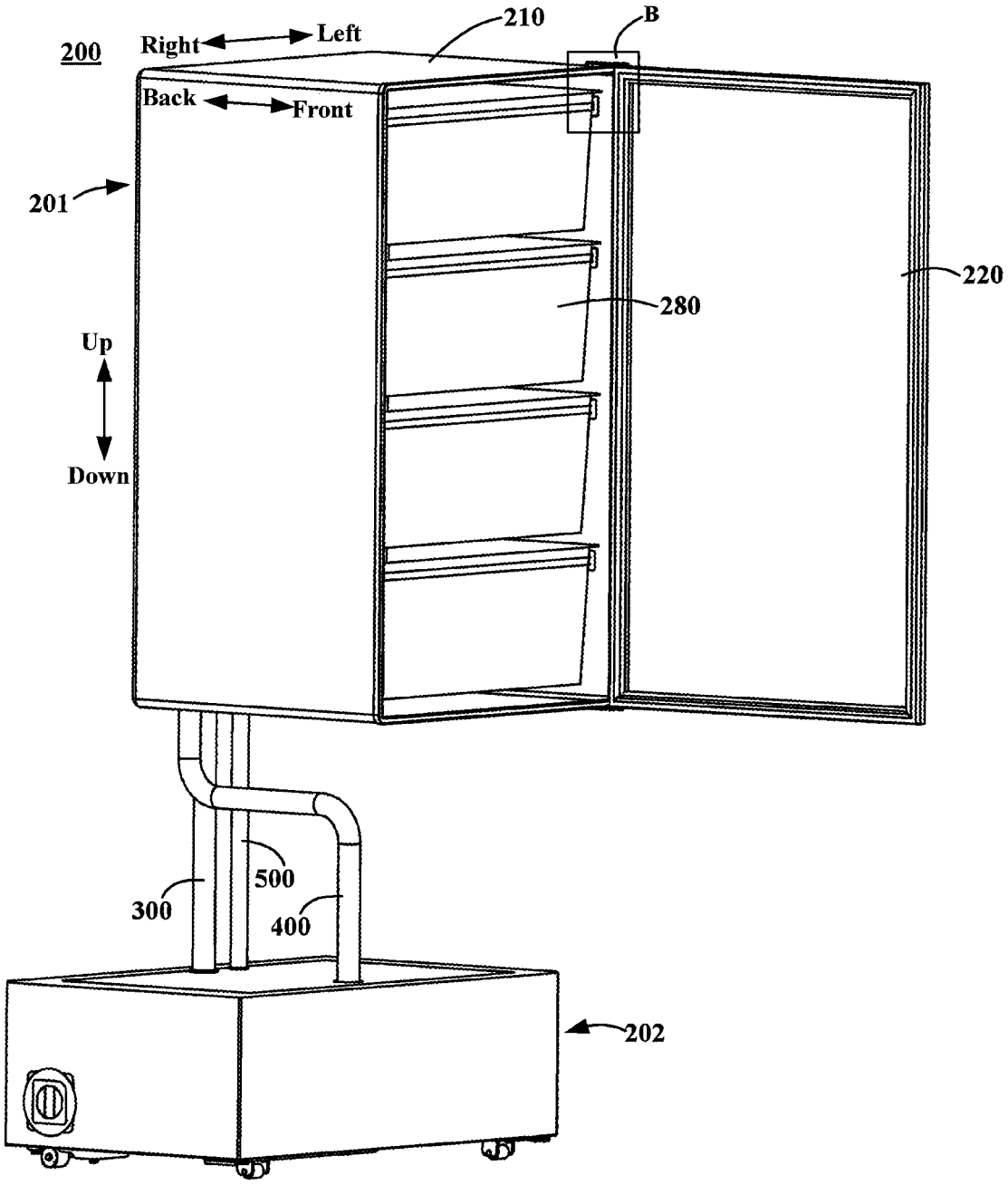
FIG. 17 is a structural schematic diagram of a refrigerator according to an embodiment of the present invention.
Figure 18:
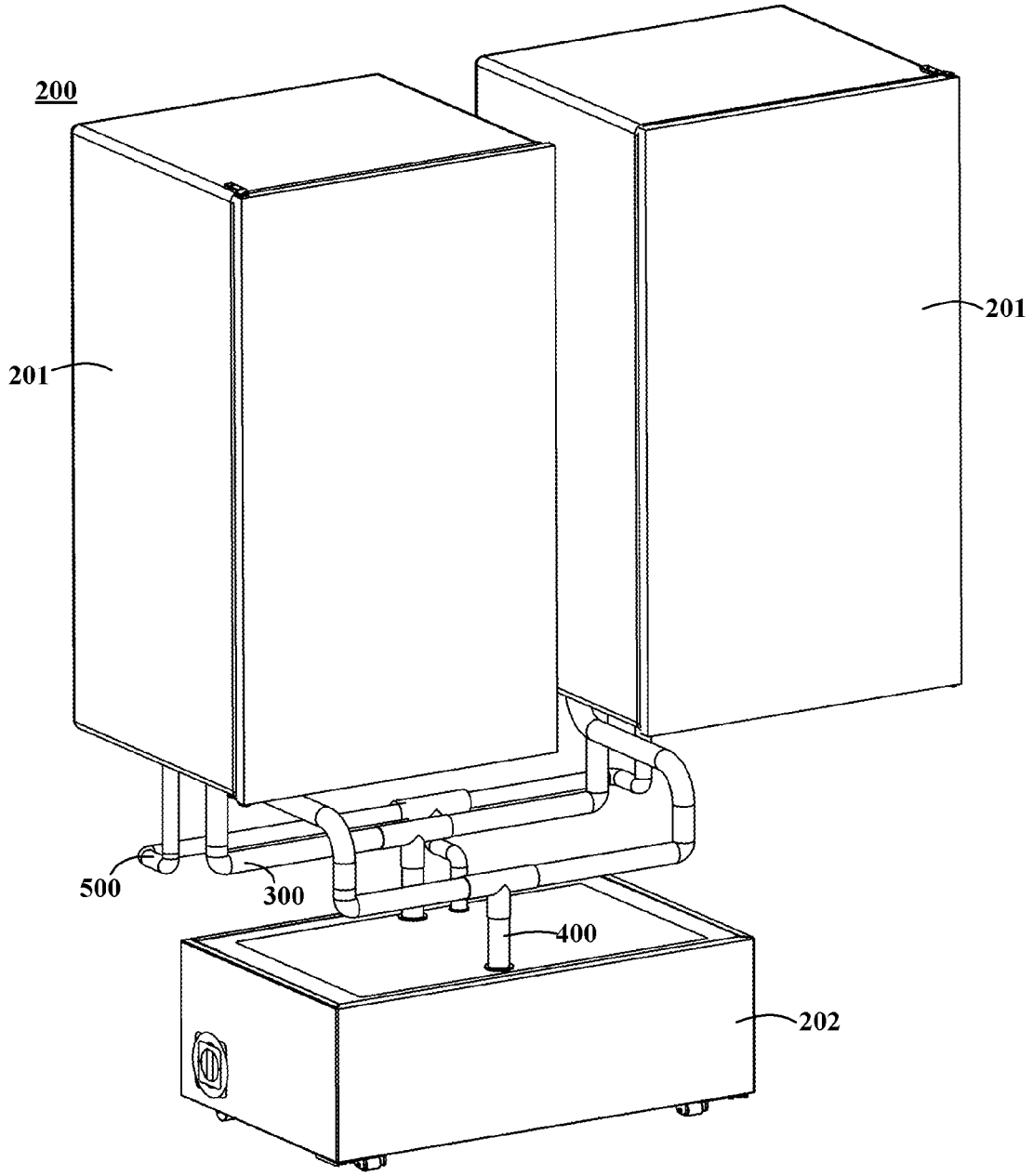
FIG. 18 is a structural schematic diagram of a refrigerator according to another embodiment of the present invention.

As introduced above, the vacuum adiabatic body 100 can be applied to the refrigerator 200. According to an embodiment of the present invention, at least part of a box body 210 of the refrigerator 200 and/or at least part of a door body 220 of the refrigerator 200 is the foregoing vacuum adiabatic body 100. FIG. 17 is a structural schematic diagram of the refrigerator 200 according to an embodiment of the present invention. FIG. 18 is a structural schematic diagram of the refrigerator 200 according to another embodiment of the present invention.

In some embodiments, a storage space is defined in the box body 210, where at least part of the box body 210 is the vacuum adiabatic body 100, the first plate 101 constitutes at least part of an outer shell 211 of the box body 210, and the second plate 102 constitutes at least part of an inner shell 212 of the box body 210, and the inner side of a second plate 102 away from a first plate 101 is the storage space. By using the vacuum adiabatic body 100, the box body 210 is formed, the wall thickness of the refrigerator 200 can be kept small while the heat preservation effect of the refrigerator 200 can be ensured; meanwhile, the internal volume of the refrigerator 200 may increase accordingly, especially suitable for a built-in refrigerator, so that a space utilization rate can be greatly increased, and user experience can be improved. The refrigerator 200 of the present invention may also be designed and used as part of a smart home. In some embodiments, referring to FIG. 1, a first plate 101 and a second plate 102 are substantially planar plate-shaped structures, and an entire box body 210 is formed by splicing a plurality of planar plate-shaped vacuum adiabatic body 100. In other embodiments, referring to FIG. 2, the first plate 101 is a cuboid shape with an opening on a surface, and through the opening, the second plate 102 is arranged in the first plate 101 in a profiling and sleeving manner at an interval, and the entire box body 210 is directly formed by a vacuum adiabatic body 100 having an opening at the front side.

In some embodiments, at least part of the door body 220 is the vacuum adiabatic body 100, the first plate 101 constitutes at least part of an outer plate 221 of the door body 220, and the second plate 102 constitutes at least part of an inner plate 222 of the door body 220. Preferably, the entire door body 220 is the vacuum adiabatic body 100.

Now, taking the refrigerator 200 with the box body 210 and the door body 220 both the vacuum adiabatic body 100 as an example, structures of a door seal 260, a hinge assembly 270, a drawer 280, a threading pipeline 500 and the like of the refrigerator 200 of the present invention will be described in detail. Meanwhile, for convenience of description, the vacuum adiabatic body 100 constituting the box body 210 is named a first vacuum adiabatic body 111, the outer shell 211 is the first plate 101 of the first vacuum adiabatic body 111, the inner shell 212 is the second plate 102 of the first vacuum adiabatic body 111, and the sealing member 103 of the first vacuum adiabatic body 111 is described as a first sealing member 131. Correspondingly, the vacuum adiabatic body 100 constituting the door body 220 is named a second vacuum adiabatic body 112, the outer plate 221 is the first plate 101 of the second vacuum adiabatic body 112, and the inner plate 222 is the second plate 102 of the second vacuum adiabatic body 112, and the sealing member 103 of the second vacuum adiabatic body 112 is described as a second sealing member 132.

Figure 19:
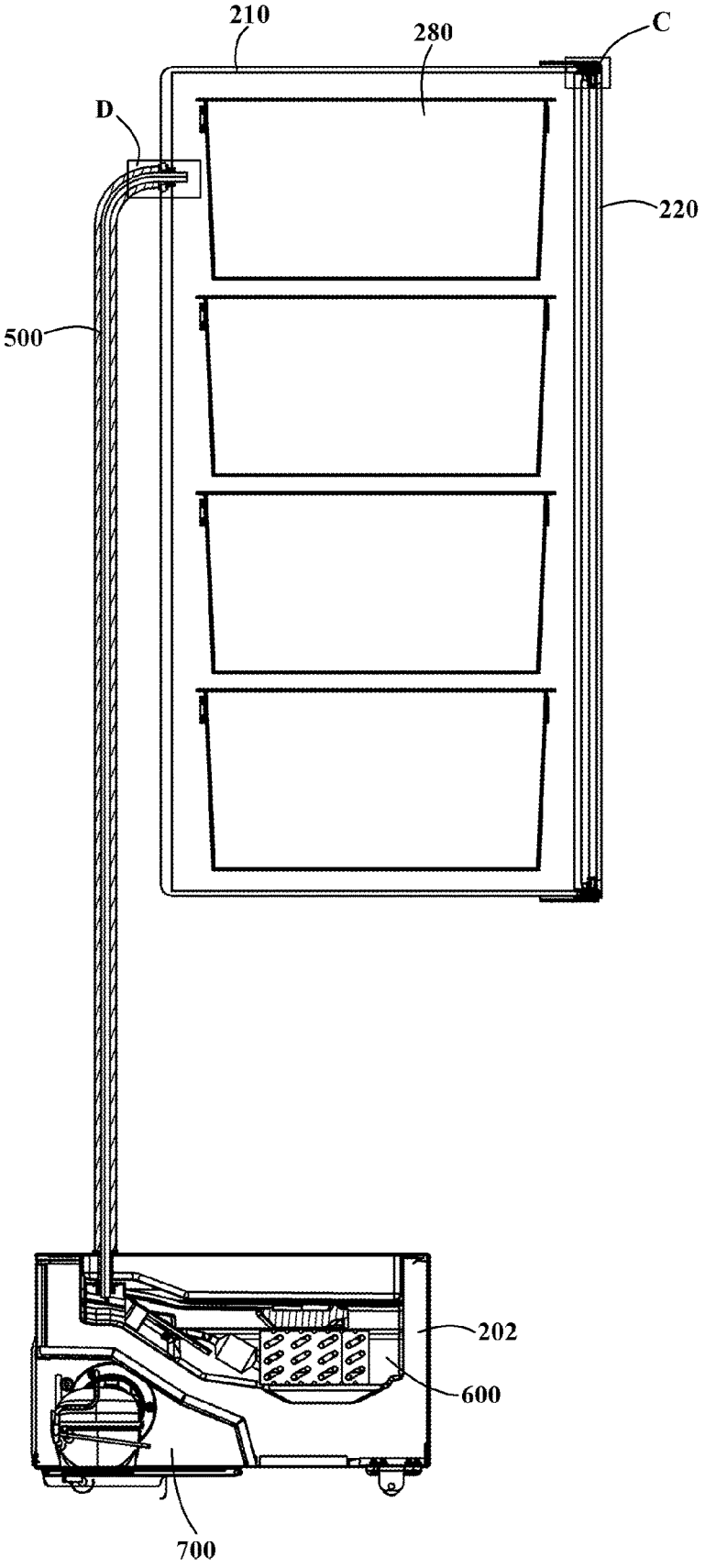
FIG. 19 is a schematic sectional view of the refrigerator shown in FIG. 17.
Figure 20:
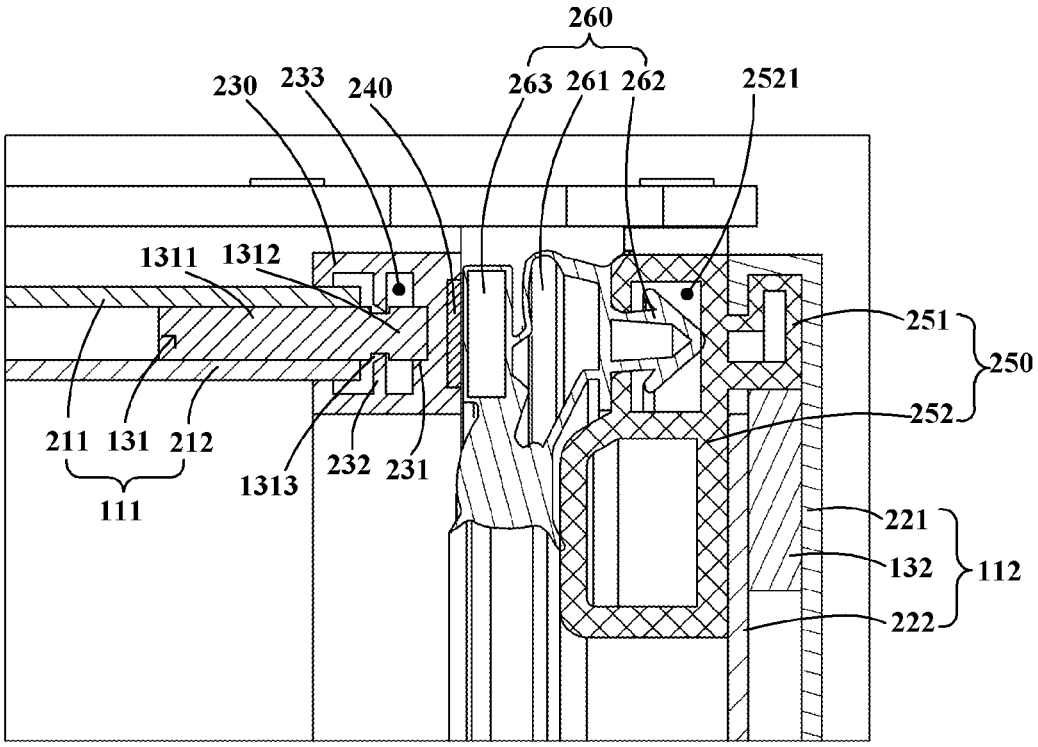
FIG. 20 is a schematic diagram of a cooperation between a box body and a door body of the refrigerator shown in FIG. 17, and is also a partial enlarged view of part C in FIG. 19.

FIG. 19 is a schematic sectional view of the refrigerator 200 shown in FIG. 17. FIG. 20 is a schematic diagram of a cooperation between the box body 210 and the door body 220 of the storage portion 201 shown in FIG. 17, and is also a partial enlarged view of part C in FIG. 19. Referring to FIG. 20, the box body 210 further includes a first frame 230 configured to wrap an end portion of the first vacuum adiabatic body 111, wherein a metal strip 240 is arranged on a side of the first frame 230 away from the first vacuum adiabatic body 111, and is used for magnetic attracting and sealing with a door seal 260. The first frame 230 is provided with a groove (not numbered in the figure) on a side away from the first vacuum adiabatic body 111, and the metal strip 240 and the first frame 230 are glued and fixed. The metal strip 240 may be stainless steel or carbon steel electroplated, and the size is about 10 mm wide*2 mm thick. The metal strip 240 and the first frame 230 can be glued and fixed by using a quick-drying silica gel.

The first sealing member 131 has a first section 1311 located between the outer shell 211 and the inner shell 212, and a second section 1312 beyond the end of the outer shell 211 and the inner shell 212; and the first frame 230 is configured to be matched and fixed with the second section 1312, so as to be fixed with the first vacuum adiabatic body 111. The first frame 230 and the second section 1312 are preferably fixed in a clamped manner, having advantages of simple structure and convenient mounting. In an assembly process of the box body 210, the first sealing member 131 is firstly sealed and fixed with the outer shell 211 and the inner shell 212 and vacuumized to form the first vacuum adiabatic body 111; and then the first frame 230 adhered with the metal strip 240 is clamped and fixed with the first vacuum adiabatic body 111. The width of the first section 1311 is preferably 10 mm to 15 mm, thereby ensuring a tight sealing of the first sealing member 131 to the outer shell 211 and the inner shell 212, and preventing the volume of the vacuum cavity 110 from reduction due to the first sealing member 131 with too large size, so that the first vacuum adiabatic body 111 is good in adiabatic effect. The width of the second section 1312 is about 10 mm, so that the first vacuum adiabatic body 111 and the first frame 230 can be stably assembled, and a heat leakage is not much. The material of the first frame 230 may be ABS, PP, etc.

Specifically, a groove 231 is formed on an inner surface of the first frame 230 close to the first vacuum adiabatic body 111 at a position corresponding to an end portion of the second section 1312; and the end portion of the second section 1312 is clamped in the groove 231 of the first frame 230. In addition, the second section 1312 is formed with a groove 1313 on an outer side surface thereof which is on a side of the outer shell 211 and an inner side surface thereof which is on a side of the inner shell 212 respectively; a protrusion 232 is formed on the inner side surface of the first frame 230 close to the first vacuum adiabatic body 111 at a position corresponding to the groove 1313 of the second section 1312 respectively; and the protrusion 232 is clamped and fixed with the groove 1313 of the second section 1312. Through a double groove and protrusion structure, a stable connection between the frame and the first vacuum adiabatic body 111 can be achieved. An end of the protrusion 232 of the first frame 230 may be arranged as a sharp corner, used as an inverted buckle, thereby being convenient for clamping into the groove 1313 of the second section 1312 during assembling. Meanwhile, after completing mounting, the first frame 230 and the first vacuum adiabatic body 111 are bounded by the protrusion 232 of the first frame 230 to define two structures 233 similar to a cavity, thereby achieving a heat insulation effect, and blocking a heat leakage at the first frame 230.

A side of the first sealing member 131 located on the outer shell 211 may be regarded as the outer side surface of the first sealing member 131, and a side located on the inner shell 212 may be regarded as the inner side surface of the first sealing member 131. The outer side surface of the first section 1311 is attached to the outer shell 211, the outer side surface of the second section 1312 faces a side where the outer shell 211 is located; the inner side surface of the first section 1311 is attached to the inner shell 212, and the inner side surface of the second section 1312 faces a side where the inner shell 212 is located. It can be understood that when the first vacuum adiabatic body 111 is described as a top wall of the box body 210, the outer side surface of the first sealing member 131 is the upper surface thereof, and the inner side surface is the lower surface thereof; when the first vacuum adiabatic body 111 is described as a bottom wall of the box body 210, the outer side surface of the first sealing member 131 is the lower surface thereof, and the inner side surface is the upper surface thereof; when the first vacuum adiabatic body 111 is described as a side wall of the box body 210, the outer side surface of the first sealing member 131 is the surface away from the storage space, and the inner side surface is the surface close to the storage space.

With continued reference to FIG. 20, the end of the outer plate 221 of the door body 220 is bent, so that an end portion of the outer plate 221 and an end portion of the inner plate 222 are arranged in an opposite manner and have a gap therebetween. The door body 220 further includes a second frame 250 configured to be fixed with the second vacuum adiabatic body 112 through the gap, and a door seal 260 is mounted on a side of the second frame 250 away from the second vacuum adiabatic body 112. The door body 220 has an ingenious structure. By bending the outer plate 221, a gap is defined between the outer plate 221 and the inner plate 222, and the second frame 250 is matched and fixed to the second vacuum adiabatic body 112 through the gap, and thus the second frame 250 and the second vacuum adiabatic body 112 can be firmly fixed, and at the same time, the appearance of the door body 220 can be kept integrated, and the user's sensory experience can be improved. In an assembling process of the door body 220, the second sealing member 132 and the outer plate 221 and the inner plate 222 are firstly sealed and fixed and vacuumized, so as to form the second vacuum adiabatic body 112; and then the second frame 250 is fixed with the second vacuum adiabatic body 112, and finally the door seal 260 is fixed with the second frame 250. The height of the second sealing 132 is preferably 10 mm to 15 mm, thereby ensuring a tight sealing of the second sealing member 132 to the outer plate 221 and the inner plate 222, and preventing the volume of the vacuum cavity 110 from reduction due to the second sealing member 132 with too large size, so that the second vacuum adiabatic body 112 is good in adiabatic effect. The material of the second frame 250 may be ABS, PP, etc. Specifically, a projection of the end portion of the second sealing member 132 in the vertical direction is located between the end portion of the outer plate 221 and the end portion of the inner plate 222; the second frame 250 has a first frame portion 251 and a second frame portion 252, wherein the first frame portion 251 is clamped in a space defined by the outer plate 221, the gap and the second sealing member 132, and the second frame portion 252 extends from the first frame portion 251 toward a side away from the second vacuum adiabatic body 112.

The side surface of the second frame portion 252 away from the first frame portion 251 is recessed to form an accommodating cavity 2521; and the door seal 260 is fixed with the second frame 250 through the accommodating cavity 2521. The door seal 260 includes an airbag 261, a base 262, and a magnetic strip 263; wherein the base 262 is formed extending from the airbag 261 toward the door body 220 and is accommodated in the accommodating cavity 2521; the magnetic strip 263 is arranged on the airbag 261, and cooperates with the metal strip 240, so that the door seal 260 is adsorbed on the box body 210.

Figure 21:
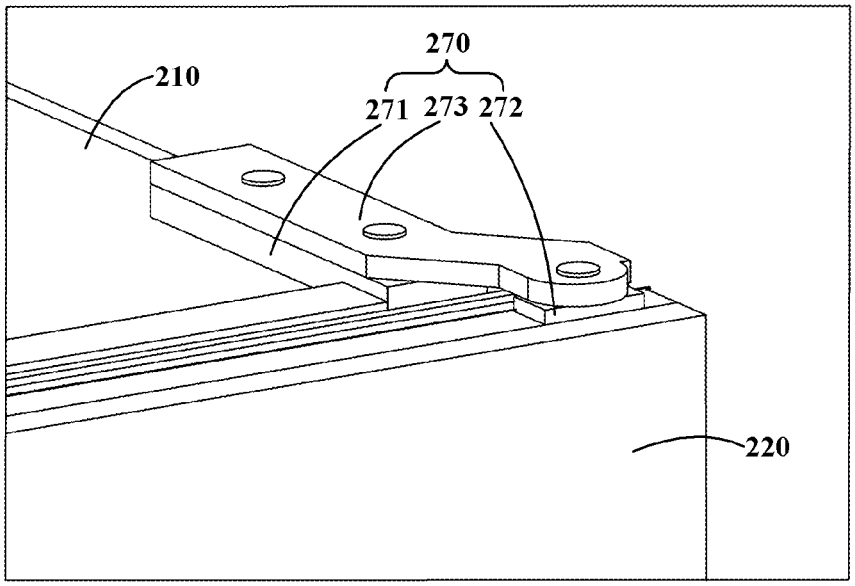
FIG. 21 is a schematic diagram of a cooperation of a box body, a door body and a hinge assembly of the refrigerator shown in FIG. 17, and is also a partial enlarged view of part B in FIG. 17.
Figure 22:
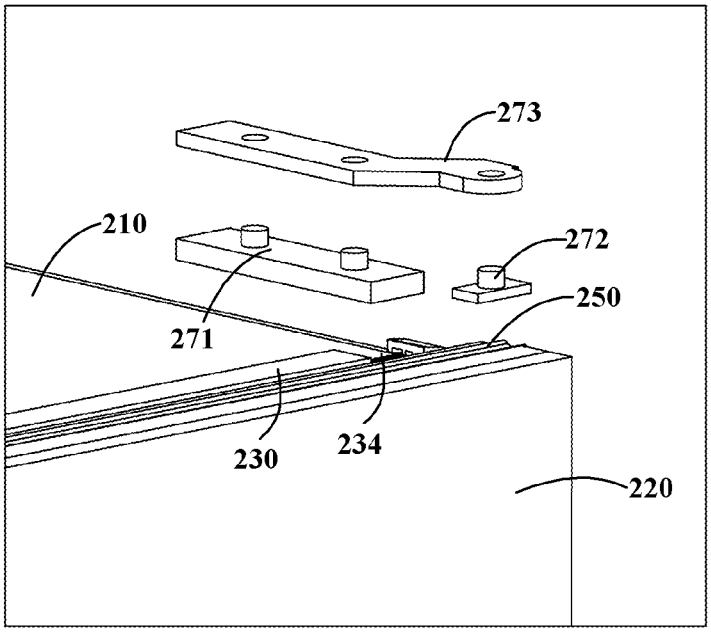
FIG. 22 is an exploded structural schematic diagram of the box body, the door body and the hinge assembly shown in FIG. 21.

FIG. 21 is a schematic diagram of a cooperation of the box body 210, the door body 220 and the hinge assembly 270 of the refrigerator 200 shown in FIG. 17, and is also a partial enlarged view of part B in FIG. 17. FIG. 22 is an exploded structural schematic diagram of the box body 210, the door body 220 and the hinge assembly 270 of FIG. 22. Referring to FIG. 21 and FIG. 22, the refrigerator 200 further includes: the hinge assembly 270. The door body 220 is pivotally arranged on a front side of the box body 210. The hinge assembly 270 is configured to cooperate with the box body 210 and the door body 220 to achieve a rotation of the door body 220. The hinge assembly 270 includes: a first base 271, a second base 272, and a hinge plate 273. The first base 271 is fixed with the box body 210; the second base 272 is fixed with the door body 220; the hinge plate 273 is connected with the box body 210 through the first base 271, and is connected with the door body 220 through the second base 272, and the rotation of the door body 220 is achieved by the hinge plate 273. The first frame 230 is correspondingly formed with a notch 234 at a position of the first base 271, and the first base 271 is a metal base, and is welded and fixed with the outer shell 211 through the notch 234. The second base 272 is a metal base, and is bonded and fixed with the second frame 250.

Figure 23:
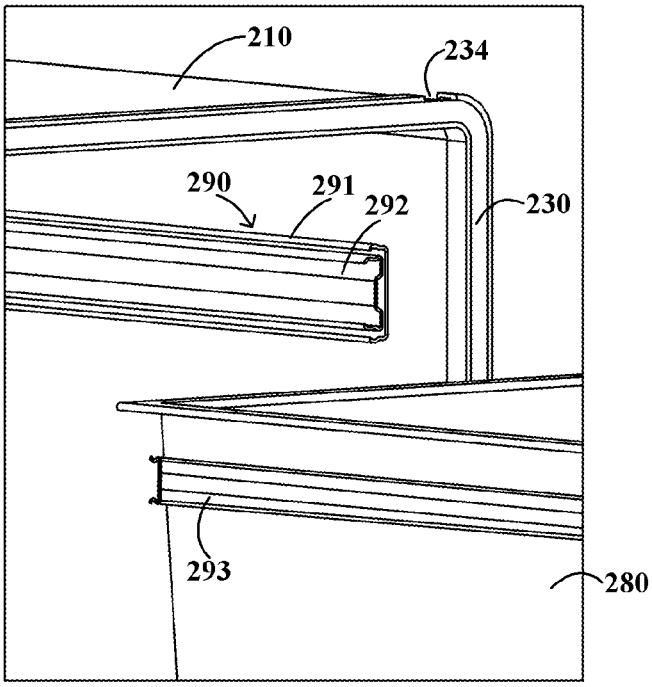
FIG. 23 is a schematic diagram of the cooperation between a box body and a drawer of the refrigerator shown in FIG. 17.

FIG. 23 is a schematic diagram of a cooperation between the box body 210 and the drawer 280 of the refrigerator 200 shown in FIG. 17. Referring to FIG. 23, the refrigerator 200 further includes: at least one drawer 280 and a sliding rail mechanism 290. The drawer 280 is arranged in the storage space and is used for storing food. The sliding rail mechanism 290 cooperates with the inner shell 212 and the drawer 280, and a pulling of the drawer 280 in the box body 210 is achieved by the sliding rail mechanism 290. The sliding rail mechanism 290 can be any sliding rail technology capable of sliding the drawer forward and backward in the prior art. In some embodiments, the sliding rail mechanism 290 includes: a fixed rail 291, a middle rail 292, and a movable rail 293. The fixed rail 291 is fixed to the inner shell 212. The middle rail 292 slides with the fixed rail 291 in an engaging manner. The movable rail 293 slides with the middle rail 292 in an engaging manner, and the movable rail 293 is connected with the drawer 280. Through a sliding of the movable rail 293 and the middle rail 292, and a sliding of the middle rail 292 in the fixed rail 291, the pulling of the drawer 280 is achieved. The fixed rail 291 and the inner shell 212 are welded and fixed or bonded and fixed. In some embodiments, a plurality of drawers 280 are sequentially arranged in the storage space from top to bottom, and the storage space is divided into a plurality of storage areas by a plurality of the drawers 280.

Figure 24:
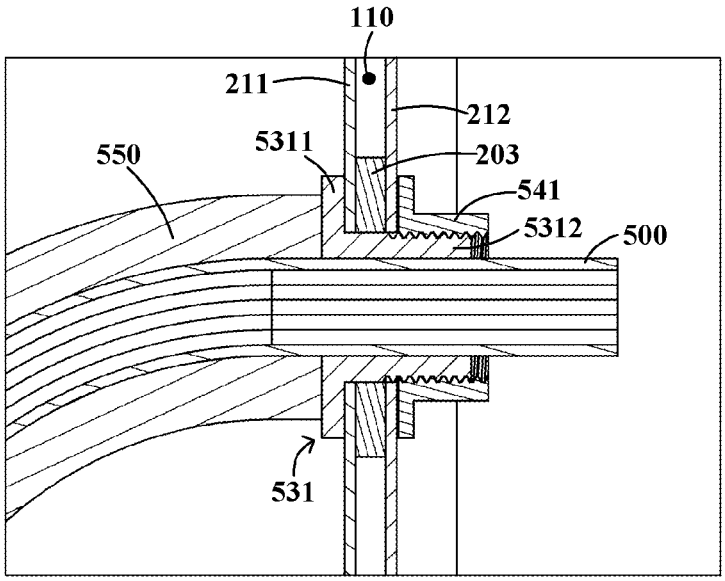
FIG. 24 is a schematic diagram of a cooperation between a threading pipeline and a box body of the refrigerator shown in FIG. 17, and is also a partial enlarged view of part D in FIG. 19.

FIG. 24 is a schematic diagram of a cooperation between the threading pipeline 500 and the box body 210 of the refrigerator 200 shown in FIG. 17, and is also a partial enlarged view of part D in FIG. 19. The refrigerator 200 further includes: the threading pipeline 500 internally provided with a power supply wire; a mounting port is arranged on the box body 210 to connect the outer shell 211 and the inner shell 212 of the box body 210, and the threading pipeline 500 is introduced into the box body 210 through the mounting port and is used for supplying power to components in the box body 210. A threading joint 531 is arranged outside the threading pipeline 500 close to the box body 210, and the threading joint 531 passes through the mounting port. The refrigerator 200 further includes a fixing member 541 configured to cooperate with the threading joint 531 in the box body 210, so as to fix the threading pipeline 500 with the box body 210. By using the cooperation of the threading joint 531 and the fixing member 541, the threading pipeline 500 is fixed with the box body 210, the structure is ingenious, the mounting is simple, and the stability is good. The threading joint 531 is provided with a joint base 5311 and a joint protrusion 5312, wherein the inner side surface of the joint base 5311 is attached to the outer side surface of the outer shell 211; the joint protrusion 5312 passes through the mounting port, and the end portion exceeds the inner shell 212; and the fixing member 541 and the joint protrusion 5312 are cooperated and fixed. Preferably, the fixing member 541 and the joint protrusion 5312 are fixed by threaded connection, the structure is simple, and the assembling is convenient and stable. The threading pipeline 500 and the threading joint 531 are integrally injection molded, so that the assembling steps can be reduced and the assembling efficiency may be improved. The material of the threading joint 531 may be PVC. The material of the fixing member 541 may be ABS or PS. A heat preservation pipe 550 may also be wrapped outside the threading pipeline 500. The heat preservation pipe 550 may be an EPU tube or an EPE tube. An adhesive tape is further arranged on the periphery of the connecting area of the threading joint 531 and the heat preservation pipe 550, and is used for wrapping and fixing the threading joint 531 and the heat preservation pipe 550. A heat insulation member 203 is arranged around the mounting port between the outer shell 211 and the inner shell 212; the heat insulation member 203 is made of quartz glass. Quartz glass has characteristics of a low thermal conductivity and a low outgassing rate to improve heat transfer at the mounting port. The heat insulation member 203 is an annular member having an annular width of 10±5 mm, preferably 10 mm to 15 mm. The annular width of the heat insulation member 203 is limited to be 10 mm to 15 mm, thereby ensuring a tight sealing between the outer shell 211 and the inner shell 212 at the mounting port, and meanwhile, preventing the volume of the vacuum cavity 110 from reduction due to the heat insulation member 203 with too large size, so that the vacuum adiabatic body 100 is good in insulation effect.

The refrigerator 200 described above may be a conventional independent refrigerator integrated with the refrigeration system and the box body 210, or may be a split-type refrigerator 200 with the refrigeration system and the box body 210 separated.

Referring to FIG. 17 and FIG. 18, the split-type refrigerator 200 is shown. The refrigerator 200 includes: one or more storage portions 201, a refrigeration module 202, an air supply pipeline 300, an air return pipeline 400, and an threading pipeline 500. The storage space is defined in the storage portion 201. The storage portion 201 includes the foregoing box body 210 and the door body 220, that is, at least part of the box body 210 and/or the door body 220 is the foregoing vacuum adiabatic body 100. The refrigeration module 202 is used for cooling air entering the refrigeration module 202 to form cold air. The storage portion 201 and the refrigeration module 202 are separately arranged, and the cold air flows out of the refrigeration module 202 through the air supply pipeline 300 and then flows into the storage portion 201. The air return pipeline 400 is communicated with the storage portion 201 and the refrigeration module 202, so as to introduce air in the storage portion 201 into the refrigeration module 202 to be cooled. A power supply wire is arranged in the threading pipeline 500, one end of the threading pipeline 500 is introduced into the storage portion 201, and the other end is introduced into the refrigeration module 202 to achieve a circuit connection between the storage portion 201 and the refrigeration module 202. According to the refrigerator 200, the refrigeration module 202 and the storage portion 201 are separately arranged, so that the storage portion 201 does not need to make way for the refrigeration system, and the internal volume of the refrigerator 200 can be greatly increased; the refrigeration module 202 is independently arranged, and one or more same or different storage portions 201 may be freely matched according to needs. For example, the refrigerator 200 shown in FIG. 17 includes one storage portion 201; the refrigerator 200 shown in FIG. 18 includes two storage portions 201. The number of the storage portions 201 may also be two or more, such as three, four. Different storage portions 201 may be arranged at different positions and have different sizes, the storage compartment may have different temperatures, so that different requirements of users can be satisfied, and experience of users can be improved. In the present invention, "being separately arranged" means that the main bodies are arranged to be spaced for a certain distance in space, and the electrical path is connected by an additional accessory. The refrigeration module 202 may use, such as a compression refrigeration system, and the compression refrigeration system includes an evaporator, a compressor, a heat dissipation fan, and a condenser. As shown in FIG. 19, the refrigeration module 202 includes an evaporator bin 600 and a compressor bin 700. The evaporator bin 600 is internally provided with an evaporator. The compressor bin 700 is separately arranged from the evaporator bin 600 and is located behind the evaporator bin 600, and the compressor, the heat dissipation fan and the condenser are arranged in the compressor bin 700.

According to the vacuum adiabatic body 100 of the present invention, by vacuumizing between two plates sealingly connected, convective heat transfer may be reduced; the first plate 101 has a first thickness, the second plate 102 has a second thickness, the first thickness is greater than the second thickness; when the vacuum adiabatic body 100 is used, the first plate 101 is usually used as an outer side plate, the second plate 102 is used as an inner side plate, so that a large first thickness can make the appearance of the vacuum adiabatic body 100 less deformed, and improve the structural stability of the vacuum adiabatic body 100, and a small second thickness can reduce the weight of the vacuum adiabatic body 100.

Further, according to the vacuum adiabatic body 100 of the present invention, the thickness of the two plates is defined, reducing a space occupied by the vacuum adiabatic body 100 while ensuring an adiabatic effect, so that the vacuum adiabatic body 100 is especially suitable for a built-in refrigerator.

Thus, it should be appreciated by those skilled in the art that while various exemplary embodiments of the invention have been shown and described in detail herein, many other variations or modifications which are consistent with the principles of the present invention may be determined or derived directly from the disclosure of the present invention without departing from the spirit and scope of the present invention. Accordingly, the scope of the present invention should be understood and interpreted to cover all such other variations or modifications.

The invention claimed is:

1. A vacuum adiabatic body, comprising:

a first plate having a first thickness;

a second plate spaced apart from the first plate in an opposite manner, and having a second thickness, and the first thickness being greater than the second thickness; and sealing members arranged between the first plate and the second plate and configured to seal and fix the first plate and the second plate, a vacuum cavity being defined among the first plate, the second plate, and the sealing members, wherein a nickel plating layer and a solder sheet are arranged between the sealing members and the first plate and between the sealing members and the second plate respectively, so as to achieve sealing and fixing of the sealing members to the first plate and the second plate, wherein the nickel plating layer is formed on an upper surface and a lower surface of the sealing members respectively, and the solder sheet is arranged between the nickel plating layer and the first plate and between the nickel plating layer and the second plate, or a metal sheet and a glass powder paste are arranged between the sealing members and the first plate and between the sealing members and the second plate respectively, so as to achieve sealing and fixing of the sealing members to the first plate and the second plate, wherein the metal sheet is arranged between the sealing members and the first plate and between the sealing members and the second plate respectively, and the glass powder paste is arranged between the sealing members and the metal sheet, or a silica gel layer is arranged between the sealing members and the first plate and between the sealing members and the second plate respectively, so as to achieve sealing and fixing of the sealing members to the first plate and the second plate.

2. The vacuum adiabatic body according to claim 1, wherein the first plate is made of a metal plate having a uniform thickness; and the second plate is made of a metal plate having a uniform thickness.

3. The vacuum adiabatic body according to claim 1, wherein the first plate is made of a stainless steel plate;

the second plate is made of a stainless steel plate; and the sealing members are made of quartz glass.

4. The vacuum adiabatic body according to claim 1, wherein the first thickness is 1.1 to 1.5 times the second thickness.

5. The vacuum adiabatic body according to claim 1, wherein the first thickness is 1.1 mm to 1.6 mm; and the second thickness is 1 mm to 1.5 mm.

6. The vacuum adiabatic body according to claim 1, wherein the sealing members are sandwiched between the first plate and the second plate, and are in surface contact with the first plate and the second plate respectively, so as to seal and fix the first plate and the second plate.

7. The vacuum adiabatic body according to claim 6, wherein a length of the sealing members sandwiched between the first plate and the second plate is 10 mm to 15 mm.

8. The vacuum adiabatic body according to claim 1, wherein a thickness of the sealing member satisfies that the thickness of the sealing member is 60% or more of a total distance between the first plate and the second plate.

9. A refrigerator, wherein at least part of a box body of the refrigerator and/or at least part of a door body of the refrigerator is the vacuum adiabatic body according to claim 1.

* * * * *